US007151235B1

(12) United States Patent
Hill

(10) Patent No.: US 7,151,235 B1
(45) Date of Patent: Dec. 19, 2006

(54) MOTION SENSOR

(76) Inventor: Carl U. Hill, 13961CR 3, Longmont, CO (US) 80504

( * ) Notice: Subject to any disclaimer, the term of this patent is extended or adjusted under 35 U.S.C. 154(b) by 0 days.

(21) Appl. No.: 11/308,406

(22) Filed: Mar. 22, 2006

Related U.S. Application Data

(60) Provisional application No. 60/595,477, filed on Jul. 8, 2005.

(51) Int. Cl.
*H01H 35/14* (2006.01)

(52) U.S. Cl. ..... 200/61.49; 200/61.48; 200/61.51

(58) Field of Classification Search ..... 200/61.45 R–61.53; 73/514.01, 514.02, 514.15, 514.21–514.24, 73/514.36, 514.38, 662, 666
See application file for complete search history.

(56) References Cited

U.S. PATENT DOCUMENTS

| | | | | |
|---|---|---|---|---|
| 2,997,558 | A * | 8/1961 | Shindledecker et al. | 200/61.48 |
| 3,053,949 | A * | 9/1962 | Johnson | 200/61.49 |
| 3,502,831 | A * | 3/1970 | McRoskey | 200/61.49 |
| 3,649,787 | A * | 3/1972 | Kasabian | 200/61.45 R |
| 4,942,386 | A * | 7/1990 | Willis | 340/566 |
| 5,408,214 | A | 4/1995 | Chalmers et al. | |
| 5,408,764 | A | 4/1995 | Wut | |
| 5,599,088 | A | 2/1997 | Chien | |
| 5,644,858 | A | 7/1997 | Bemis | |
| 5,789,716 | A | 8/1998 | Wang | |
| 5,866,987 | A | 2/1999 | Wut | |
| 5,955,712 | A * | 9/1999 | Zakutin | 200/61.48 |
| 6,065,851 | A | 5/2000 | So | |
| 6,238,056 | B1 | 5/2001 | Rapisarda | |
| 6,545,235 | B1 * | 4/2003 | Chou | 200/61.51 |
| 6,776,498 | B1 | 8/2004 | Yeung | |
| 6,784,386 | B1 * | 8/2004 | Chou et al. | 200/61.51 |
| 6,949,713 | B1 * | 9/2005 | Weng et al. | 200/61.45 R |

* cited by examiner

*Primary Examiner*—Michael A Friedhofer
(74) *Attorney, Agent, or Firm*—Ancel W. Lewis, Jr.

(57) ABSTRACT

A motion sensor for tire pressure monitors and other applications includes an insulative collar, a conductive coil spring mounted on the cap, a conductive connector that extend through the cap and connects to the spring, and a conductive can around and spaced from the spring. The cap closes and seals the open end of the can. Acceleration of the motion sensor causes the coil spring to make electrical contact with the can to act as a switch closure.

10 Claims, 3 Drawing Sheets

MOTION SENSOR

This application claims the benefit under 35 U.S.C. § 119(e) of the U.S. provisional patent application No. 60/595,477 filed Jul. 8, 2005.

FIELD OF THE INVENTION

This invention relates to sensing devices and more particularly to a motion sensor that is particularly suited for tire pressure monitors and systems.

BACKGROUND ART

There are a number to tire pressure monitoring devices and systems presently on the market. Generally the tire pressure monitoring devices are mounted inside the tire. Powering such a device, inside a tire on a rotating wheel, with the vehicle electrical system would be complex and expensive. Therefore, these known tire pressure monitoring devices include batteries for electrical power.

Since these known tire pressure monitoring devices are inside a tire, battery replacement is difficult. A motion sensor can be incorporated into the devices to reduce power consumption and extend battery life. Such a motion sensor can sense tire rotation and turn the tire pressure monitoring device on when the tire rotates above a selected speed.

DISCLOSURE OF THE INVENTION

A motion sensor includes a cap, a coil spring, a connector and a can. The cap is made of an electrically insulative material. The spring is electrically conductive and mounts on the cap. The connector electrically connects to the coil spring and extends through the cap. The can has a electrically conductive inner surface forming an interior cavity surrounding the spring. The spring is spaced a selected distance from the inner surface of the can. The can has an open first end and a spaced, closed second end. The cap fits into and seals the open end of the can. During acceleration of the motion sensor, the coil spring flexes to contact the inner surface of the can to electrically connect the can to the connector.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
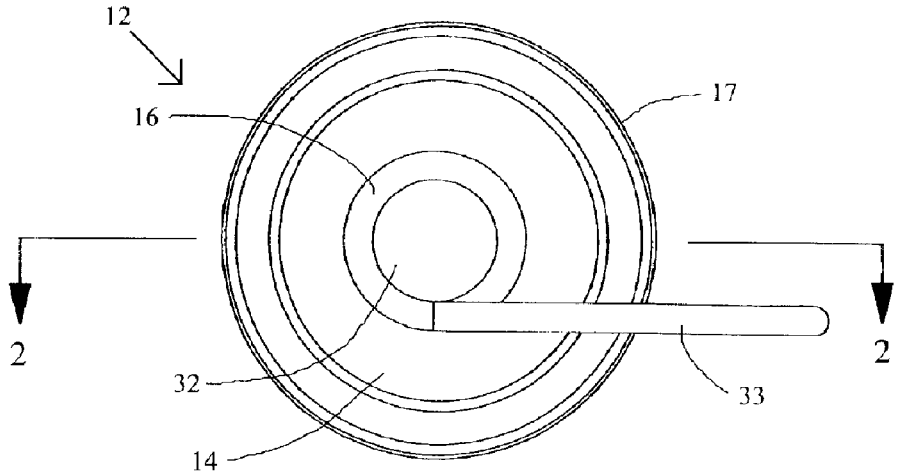
FIG. 1 is a bottom view of a motion sensor embodying features of the present invention.
Figure 2:
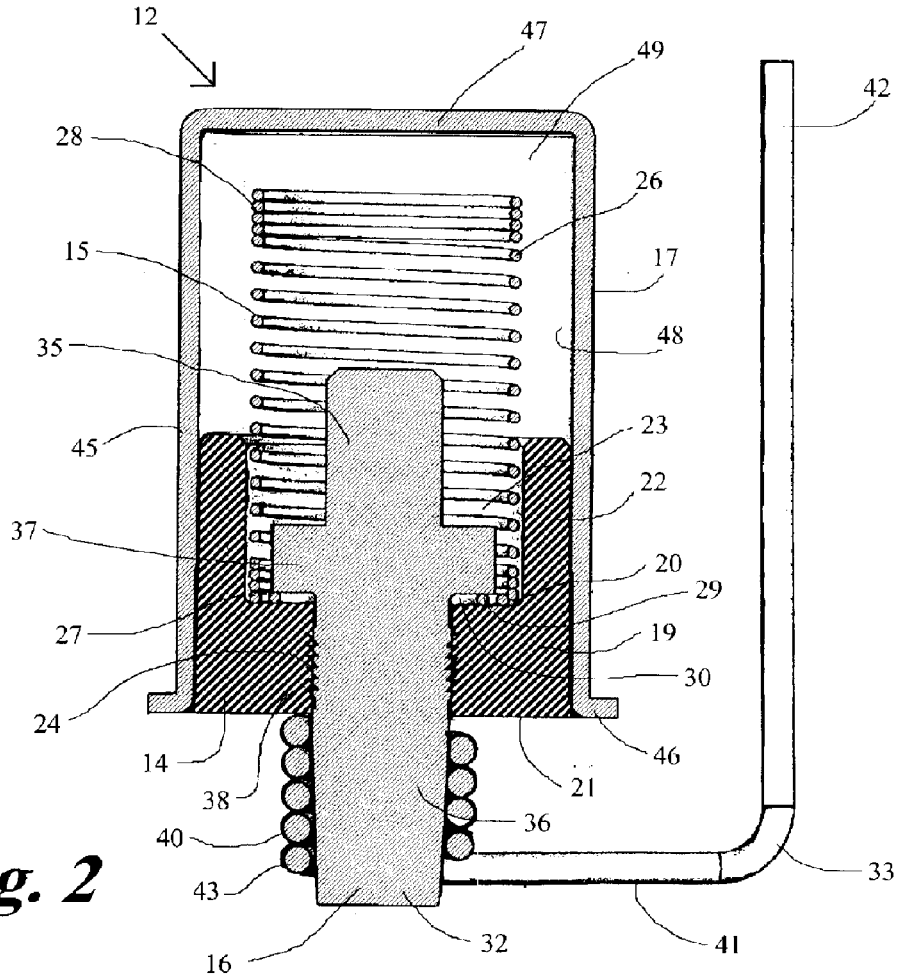
FIG. 2 is a sectional view of the sensor of FIG. 1 taken along line 2—2.

Referring to FIGS. 1 and 2, a motion sensor 12 embodying features of present invention includes a cap 14, a spring 15, a connector 16 and an outer housing or can 17. The cap 14 is made of an insulative material. The cap 14 has a substantially cylindrical base portion 19 with a first face 20 and a spaced, oppositely facing second face 21. A circumferential wall 22 projects from the first face 20, forming a spring well 23. A central aperture 24 extends through the base portion 19 from the first face 20 to the second face 21.

The spring 15 is made of an electrically conductive, elastic material and is a coil spring having a plurality of turns 26. The turns 26 are formed of wire having a selected diameter. The spring 15 is generally cylindrical with spaced first and second ends 27 and 28. The first end 27 has an inwardly projecting, transverse lip 29 formed by several turns 26 coiling inwardly. A spring aperture 30 formed by the lip 29 is sized to match the central aperture 24 of the base portion 19 of the cap 14.

The connector 16 includes a stem 32 and a pin portion 33, each made of an electrically conductive material. The stem 32 has a cylindrical inner portion 35, a substantially cylindrical outer portion 36, and a shoulder portion 37 between the inner and outer portions 35 and 36. The shoulder portion 37 extends radially outwardly relative to the inner and outer portions 35 and 36. The shoulder portion 37 is sized to fit into the spring and is larger in diameter than the spring aperture 30. The outer portion 36 is sized to fit through the spring aperture 30, and to fit into and seal the central aperture 24 of the base portion 19 of the cap 14. The outer portion 36 includes a plurality of protruding sharp ridges 38.

The pin portion 33 includes a coil section 40, a transverse section 41 and a parallel section 42. The coil section 40 has a plurality of coils 43 sized to receive the outer portion 36 of the stem 32. The transverse section 41 extends from the coil section 40 transverse to the stem 32. The pin portion 33 bends between the transverse and parallel sections 41 and 42 with the parallel section 42 extending from the transverse section 41 parallel to the stem 32.

The can 17 includes a cylindrical portion 45, and spaced first and second ends 46 and 47. The first end 46 is open and the second end 47 is closed. The inner surface 48 of the can 17 is made of an electrically conductive material and forms an interior cavity 49. The base portion 19 of the cap 14 is sized to fit into and seal the first end 46 of the can 17.

The motion sensor 12 is assembled as follows. The spring 15 is placed on the stem 32 with the outer portion 35 of the stem 32 projecting through the spring aperture 30. The outer portion 36 of the stem 32 is pressed through the central aperture 24 of the base portion 19 of the cap 14, with the first end 27 of the spring 15 in the spring well 23 of the cap 14. The ridges 38 of the outer portion 36 of the stem 32 seal the central aperture 24 of the base portion 19 of the cap 14. The cap 14 is pressed into the can 17, with the spring 15 inside the can 17 and the cylindrical portion 45 of the can 17 spaced concentrically around the spring 15. Preferably, the base portion 19 of the cap 14 is sized to expand the sides of the can 17 to seal the interior cavity 49. The motion sensor 12 is sealed to prevent corrosion of the inner surface 48 and the spring 15.

The motion sensor 12 can be very small. By way of example, and not as a limitation, the length of the can 17 can be about 0.25 to 0.33 inches and the diameter of the can 17 can be about 0.187 inches. The motion sensor 12 can be assembled to a circuit board with the parallel section 42 of the pin portion 33 of the connector 16 extending through the circuit board by electrically connecting the parallel section 42 and the second end 47 of the can 17 to the circuit board.

Figure 3:
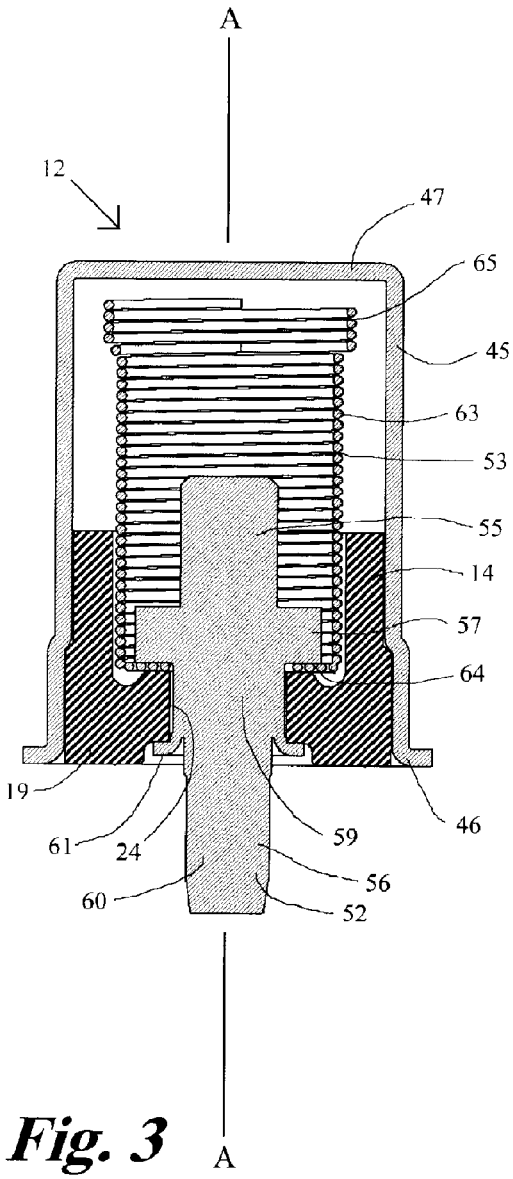
FIG. 3 is a sectional view of the sensor of FIG. 1 taken along line 2—2 with an alternative spring and an alternative stem.
Figure 4:
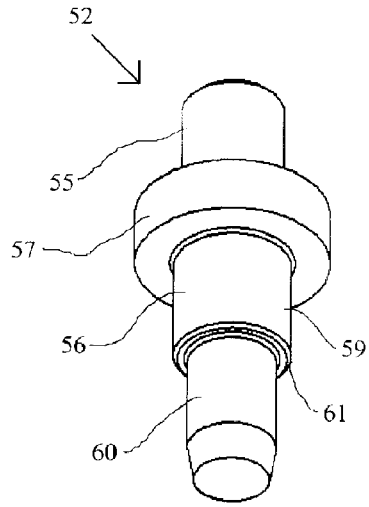
FIG. 4 is a perspective view of the stem of FIG. 3.

FIG. 3 shows a motion sensor 12 with an alternative stem 52 and an alternative spring 53. Referring to FIG. 4, the stem 52 has a cylindrical inner portion 55, an outer portion 56, and a shoulder portion 57 between the inner and outer portions 55 and 56. The outer portion 56 has a cylindrical first section 59 extending from the shoulder portion 57, and a second section 60, with a smaller diameter than the first section 59, extends from the first section 59. The first section 59 has a cylindrical, projecting lip 61 that forms a circular groove with the second section 60, at the connecting point of the first and second sections 59 and 60. As shown in FIG. 3, after outer portion 56 of the stem 52 is assembled into the central aperture 24 of the base portion 19 of the cap 14, the lip 61 is pressed or expanded outwardly to seal the central aperture 24.

The spring 53 is made of an electrically conductive, elastic material and is a coil spring having a plurality of turns 63. The turns 63 are formed of wire having a selected diameter. The spring 53 is generally cylindrical with spaced first and second ends 64 and 65. The first end 64 of the spring 53 is similar to the first end 27 of the spring 15, previously described. The has one or more turns 63 that flair or diverge outwardly, having a larger diameter than the remainder of the turns 63.

The motion sensor 12 is substantially omnidirectional. When the motion sensor 12 is accelerated transverse to the axis A of the can 17, the spring 53 bends and the second end 65 of the spring 53 contacts the inner surface 48 of the can 17, thereby electrically connecting the can 17 to the connector 16. The sensitivity of the motion sensor 12, in terms of the acceleration required for the second end 65 of the spring 53 to contact the inner surface 48 of the can 17, can be selected in several ways. The sensitivity is selected, by way of example, and not as a limitation by selection of the diameter of the wire of the turns 63 of the spring 53, the length of the spring 53, the height of the wall 22 of the base portion 19 of the cap 14, and the distance from the inner surface 48 of the can 17 to the second end 65 of the spring 53. The distance from the inner surface 48 of the can 17 to the second end 65 of the spring 53 by selecting the diameter of the inner surface 48 of the can 17 and by selecting the flair of the second end 65 of the spring 53.

Figure 5:
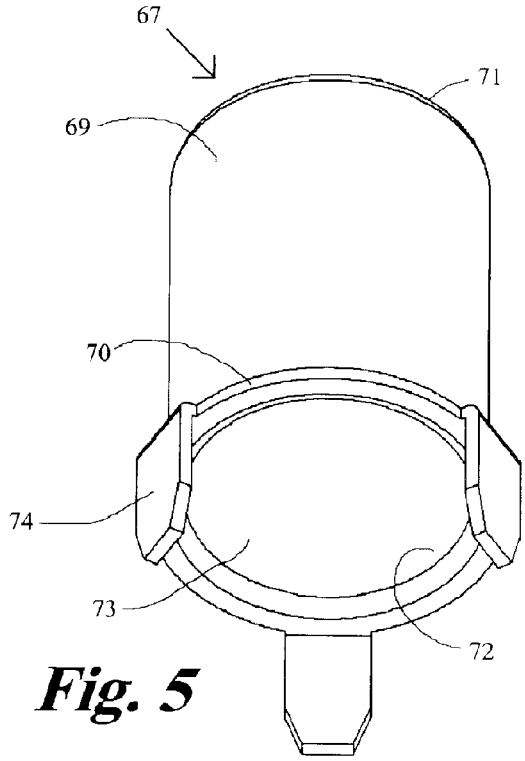
FIG. 5 is a perspective view of an alternative can for the motion sensor of FIG. 1.

Referring to FIG. 5, an alternative can 67 includes a cylindrical portion 69, and spaced first and second ends 70 and 71. The first end 70 is open and the second end 71 is closed. The inner surface 72 of the can 67 is made of an electrically conductive material and forms an interior cavity 73. The base portion 19 of the cap 14 is sized to fit into and seal the first end 70 of the can 67. A plurality of circumferentially spaced tabs 74 project from the first end 70 of the can 67. The can 67 is used with a connector 16 having only the stem 33 or 52, without the pin portion 33. The tabs 74 of the can 67 and the stem 33 or 52 can mount directly to a circuit board.

Figure 6:
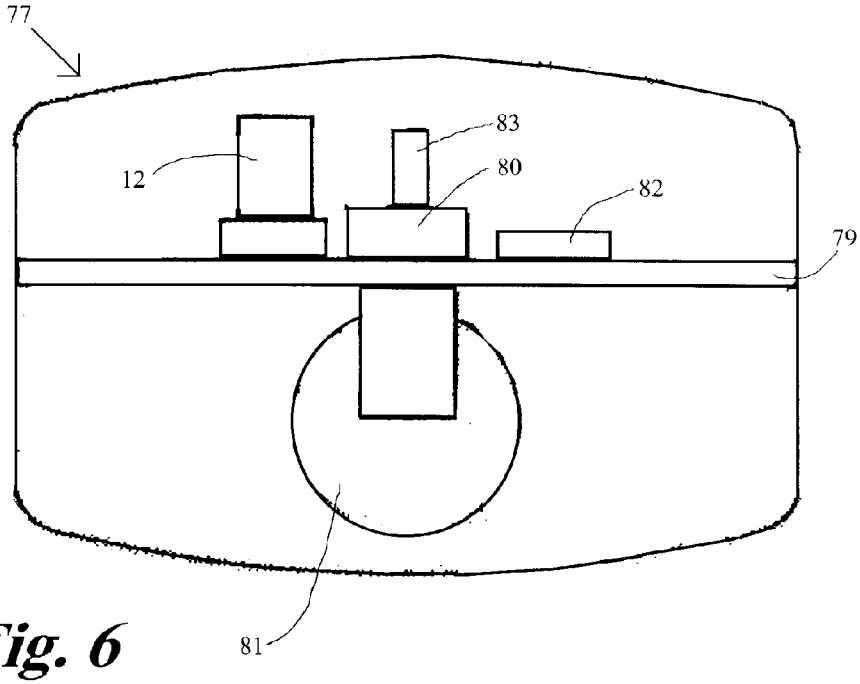
FIG. 6 is a diagramic view of a tire pressure monitoring device with the motion sensor of FIG. 1.

FIG. 6 shows a tire pressure monitoring device 77 including a circuit board 79, an air pressure measuring device 80, a battery 81, an integrated circuit 82, a transceiver 83 and the motion sensor 12. The motion sensor 12 and integrated circuit 82 are both connected to the battery 81, and to the air pressure measuring device 80 and transceiver 83. The tire pressure monitoring device 77 is mounted in a tire and when the tire reaches a selected speed, centrifugal force causes the second end 65 of the spring 53 to contact the inner surface 48 of the can 17, activating the air pressure measuring device 80 and the transceiver 83. The integrated circuit 82 latches the power to the air pressure measuring device 80 and the transceiver 83 for a selected time, such as 3 seconds, to provide consistent power when the tire is rolling near the minimum speed.

Figure 7:
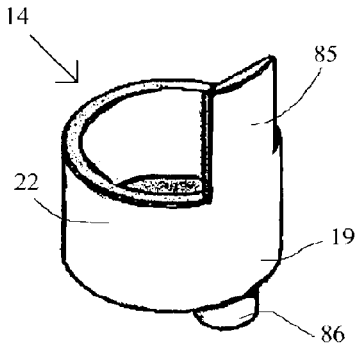
FIG. 7 is a perspective view of modified cap for the motion sensor of FIG. 1.
Figure 8:
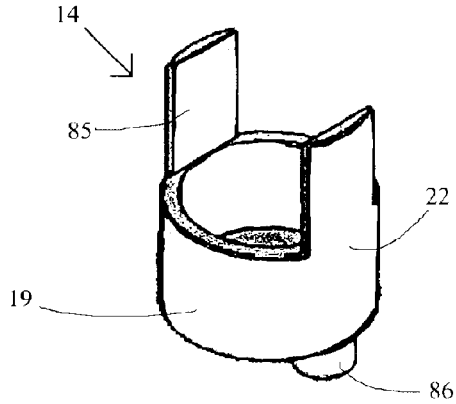
FIG. 8 is a perspective view of another modified cap for the motion sensor of FIG. 1.

Referring to FIG. 7, modified cap 14 includes a tab 85 that projects from the wall 22. When the motion sensor 12 is assembled, the tab 85 projects between the spring 15 and the inner surface 48 of the can 17. When the motion sensor 12 is assembled, the tab 85 extends substantially to the second end 28 of the spring 15. The tab 85 prevents the second end 28 of the spring 15 from contacting the inner surface 48 of the can 17 when the motion sensor 12 is accelerated in a direction opposite the tab 85. A stub 86 projecting from the base portion 19 opposite the wall 22 assures correct orientation of the motion sensor 12. FIG. 8 shows another modified cap 14 with two tabs 85, at 180 degree relative to each other, projecting from the wall 22. The tabs 85 make the motion sensor directional. Other arrangements of tabs 85 can be provided.

Although the motion sensor 12 has been described for use in a tire pressure monitoring system, the motion sensor 12 can be used in other applications where acceleration or shock must be sensed. By way of example, and not as a limitation, such applications can include an acceleration switch for safe arm devices in bombs and missiles, an anti-theft sensor for electronics boxes, and a shock sensor for packages.

Although the present invention has been described with a certain degree of particularity, it is understood that the present disclosure has been made by way of example and that changes in detail of structure may be without departing from the spirit thereof.

What is claimed is:

1. A motion sensor comprising:

a cap of an electrically insulative material, an electrically conductive coil spring having a first end mounted on said cap and a second end spaced from said first end, an electrically conductive connector electrically connected to said spring and extending through said sap, and a can having an electrically conductive inner surface surrounding said spring and spaced therefrom, said inner surface forming an interior cavity, said can having an open first end size to receive said cap and a second end spaced opposite said first end, whereby said spring flexes and said second end of said spring contacts said inner surface to electrically connect said can to said connector when said can is accelerated, said cap having a base portion with said first end of said spring being mounted on said base portion, and said cap having a circumferential wall portion extending a selected height from said base portion into said interior cavity, between said spring and said inner surface of said can, said height being selected such that said second end of said spring contacts said inner surface at a selected acceleration rate.

2. The motion sensor as set forth in claim 1 wherein said inner surface of said can includes a cylindrical portion spaced concentrically around said spring.

3. The motion sensor as set forth in claim 2 wherein said cylindrical portion is spaced a selected distance from said second end of said spring, said distance being selected such that said second end of said spring contacts said inner surface at a selected acceleration rate.

4. The motion sensor as set forth in claim 2 wherein said second end of said spring flares outwardly, and said cylindrical portion is spaced a selected distance from said second end of said spring, said distance being selected such that said second end of said spring contacts said inner surface at a selected acceleration rate.

5. The motion sensor as set forth in claim 1 wherein said spring is formed from wire of a selected diameter, said diameter being selected such that said second end of said spring contacts said inner surface at a selected acceleration rate.

6. The motion sensor as set forth in claim 1 wherein said spring has a selected length, said length being selected such that said second end of said spring contacts said inner surface at a selected acceleration rate.

7. The motion sensor as set forth in claim 1 wherein said second end of said can is closed and said cap seals said first end of said can, whereby said spring is sealed inside said interior cavity.

8. A motion sensor comprising:

a cap of an electrically insulative material, an electrically conductive coil spring having a first end mounted on said cap and a second end spaced from said first end, an electrically conductive connector electrically connected to said spring and extending through said cap, and a can having an electrically conductive inner surface surrounding said spring and spaced therefrom, said inner surface forming an interior cavity, said can having an open first end sized to receive said cap and a second end spaced opposite said first end, whereby said spring flexes and said second end of said spring contacts said inner surface to electrically connect said can to said connector when said can is accelerated, said cap including a tab that projects into said interior cavity between said spring and said inner surface, said tab extending substantially to said second end of said spring, whereby said tab prevents said second end of said spring from contacting said inner surface when can is accelerated in a direction opposite said tab.

9. A motion sensor comprising:

a cap of an electrically insulative material, an electrically conductive coil spring having a first end mounted on said cap and a second end spaced from said first end, an electrically conductive connector electrically connected to said spring and extending through said cap, and a can having an electrically conductive inner surface surrounding said spring and spaced therefrom, said inner surface forming an interior cavity, said can having an open first end sized to receive said cap and a second end spaced opposite said first end, whereby said spring flexes and said second end of said spring contacts said inner surface to electrically connect said can to said connector when said can is accelerated, said first end of said spring including an inwardly coiling, transverse lip, and said connector including a stem that extends through said cap, said stem including a shoulder portion sized to fit over said lip of said first end of said spring to secure said first end of said spring against said cap, wherein said connector includes a pin portion that connects to said stem, projects transversely from said stem beyond said can, bends, and projects along and spaced from said can to substantially beyond said second end of said can.

10. The motion sensor as set forth in claim 9 wherein said connector includes a pin portion that connects to said stem, projects transversely from said stem beyond said can, bends, and projects along and spaced from said can to substantially beyond said second end of said can.

* * * * *